US006039840A

United States Patent [19]

Kytönen et al.

[11] Patent Number: 6,039,840

[45] **Date of Patent: *Mar. 21, 2000**

[54] ROLL FOR A SUPERCALENDER AND METHOD FOR CALENDERING A WEB

[75] Inventors: Pauli Kytönen, Tuusula; Juha Koriseva; Erkki Leinonen, both of Järvenpää , all of Finland

[73] Assignee: Valmet Corporation, Helsinki, Finland

[ * ] Notice: This patent is subject to a terminal disclaimer.

[21] Appl. No.: 09/213,030

[22] Filed: Dec. 16, 1998

Related U.S. Application Data

[63] Continuation of application No. 08/828,274, Mar. 21, 1997.

[30] Foreign Application Priority Data

Apr. 11, 1996 [FI] Finland ..... 961585

[51] Int. Cl.[7] ..... D21G 1/02

[52] U.S. Cl. ..... 162/205; 100/155 R; 100/169; 162/361; 492/56

[58] Field of Search ..... 162/205, 206, 162/361; 100/155 R, 169, 176; 492/48, 56

[56] References Cited

U.S. PATENT DOCUMENTS

| | | | |
|---|---|---|---|
| 3,750,246 | 8/1973 | Pessen | 492/56 |
| 4,534,829 | 8/1985 | Ahrweiler et al. | 162/361 |
| 5,092,235 | 3/1992 | Rise | 100/176 |
| 5,146,664 | 9/1992 | Biondetti | 29/116.2 |
| 5,412,870 | 5/1995 | Lehtonen | 29/895.32 |
| 5,582,568 | 12/1996 | Lehtonen | 492/59 |
| 5,662,574 | 9/1997 | Slotten | 100/176 |

FOREIGN PATENT DOCUMENTS

| | | |
|---|---|---|
| 0613729 | 9/1994 | European Pat. Off. . |
| 2153871 | 5/1973 | France . |
| 502651 | 12/1995 | Sweden . |
| 795523 | 5/1958 | United Kingdom . |

OTHER PUBLICATIONS

"Synthetic Composite Covers in Supercalenders:Update", Thomas J. Lauterbach, Tappi Journal, vol. 76, No. 6, Jun. 1993, pp. 115–119.

IBM Technical Disclosure Bulletin, vol. 27, No. 1A, Jun. 1984, "Uniform Pressure Roll", T.E. Bruning and T.R. Meyer, pp. 170–171.

*Primary Examiner*—Karen M. Hastings
*Attorney, Agent, or Firm*—Steinberg & Raskin, P.C.

[57] ABSTRACT

A paper machine roll, in particular a roll for a supercalender, which includes a frame and a polymer coating on the frame. The deformability of the polymer coating on the roll increases within a certain axial distance from the middle area of the roll toward the ends of the roll in order to compensate for the deformation state of the end areas of the roll frame, which deformation state is uneven when the roll is loaded.

18 Claims, 2 Drawing Sheets

ROLL FOR A SUPERCALENDER AND METHOD FOR CALENDERING A WEB

CROSS-REFERENCE TO RELATED APPLICATION

This application is a continuation of U.S. patent application Ser. No. 08/828,274 filed Mar. 21, 1997.

FIELD OF THE INVENTION

The present invention relates to a paper machine roll, in particular a roll for a multi-nip calender or supercalender, which comprises a frame and a polymer coating.

The present invention also relates to a method for calendering a web by passing the web through one or more nips defined by a hard roll and a polymer-coating roll.

BACKGROUND OF THE INVENTION

As known in the prior art, coated rolls are used in paper machines and in paper finishing devices in highly different applications. As examples of such applications, soft rolls of calenders, for example of supercalenders, should be mentioned. Usually the soft coatings on rolls are made of organic polymers or mixtures thereof, which often also include inorganic elements. The soft coatings on rolls are often made of a composite structure, which comprises layers made of different materials.

Supercalenders consist of a number of rolls arranged one above the other (adjacent ones of which are in nip-defining relationship), and the rolls are alternatingly soft and hard. In this manner, the paper web runs successively through a number of nips. In a typical supercalender, the hard rolls are made of metal, usually steel and/or cast iron, and the soft rolls are paper-filled or fabric-filled. Since the metal rolls in the pairs of rolls are usually heated in order to obtain good calendering results, one problem in the calendering has been the poor ability of the resilient paper-filled or fabric-filled rolls to endure high temperatures. Owing to this, polymer-coated rolls have been introduced in calendering.

The frame of polymer-coated rolls does not have a uniform rigidity in the longitudinal direction of the roll, but the end areas are more rigid than the middle area of the roll frame. FIG. 1 is a schematic illustration of the state of deformation in a radial direction (i.e., cross-sectional deformation) of the roll frame of a polymer roll during deformation in the middle area and at one end of the roll, which arises due to the difference in rigidity. In this manner, in a polymer roll, a higher load arises in the lateral areas than in the middle when such rolls are used in situations in which the paper web or equivalent fibrous material layer is run through a nip between such a polymer-coated roll and a hard roll, and in particular when there is a roll at each side of a polymer-coated roll, for example in supercalendering. In the case of supercalendering, the quality in the lateral areas of the web can suffer as a result of the higher load effective in the lateral areas of the paper web. In calenders, attempts have been made to solve this problem by controlling the nip load, but by means of the control of the nip load alone, it has not been possible to rectify this problem to a sufficient extent.

With respect to the prior art, Slotten (U.S. Pat. No. 5,662,574) describes a pressure roller including an elongate central core, a roller body arranged on the central core and a thin outer shell arranged on the roller body. The central core of the roller of Slotten is not deformable such that it deforms less in lateral areas than in a middle area during loading of the roll. Rather, the central core is made "of a material and of a construction that resists deformation" (see col. 2, lines 33–34) and as such, does not operatively deform differently in the lateral areas and in a middle area.

Pessen (U.S. Pat. No. 3,750,246) describes a composite roll A for controlled deflection in calendering operations to correct distortion of the roll during calendering. Composite roll A includes a metal shaft or core member B and a metal outer cylindrical shell. The core member B is not deformable such that it deforms less in lateral areas than in a middle area during loading of the roll. Rather, the core member B is "substantially rigid" (see claim 1, lines 1–2) and as such, would not operatively deform differently in the lateral areas and in a middle area.

Rise (U.S. Pat. No. 5,092,235) describes rollers 40,42 defining a high pressure nip through which ink-containing sheet material is passed. Each roller 40,42 may include a core 54, an elastomer 56 arranged on the core 54 and a shell 50 arranged on the elastomer 56. Core 54 of the rollers 40,42 of Rise is not deformable such that it deforms less in lateral areas than in a middle area during loading of the roll. Rather, the core 54 is made of "a rigid, preferably non-compliant, material such as steel" (col. 6, lines 22–23) and as such, does not operatively deform differently in the lateral areas and in a middle area.

Lehtonen (U.S. Pat. No. 5,412,870) shows a coated roll having a polymer coating which may be variable along the axial length of the roll. The roll is not deformable such that it deforms less in lateral areas than in a middle area during loading of the roll. Rather, the roll provides a uniformly rigid substrate in the axial length of the roll such that the hardness of the roll is determined solely by the manner in which the coating is applied to the outer surface of the roll, i.e., the surface hardness of the roll being regulated sole by using the functions derived according to Lehtonen (col. 5, lines 24–31).

Great Britain Patent No. 795,523 describes a pressure rollers including a core a', a rubber layer b' having a uniform thickness and a resilient cover c' having a variable thickness. Core a' of the rollers is not deformable such that it deforms less in lateral areas than in a middle area during loading of the roll. Rather, the core a' is made of "hard steel" (page 2, lines 97–100) or another "non-resilient" material (page 3, lines 11–15), and as such, does not operatively deform differently in the lateral areas and in a middle area. Moreover, the roll has a solid roll frame which is generally, uniformly rigid in the axial direction.

IBM Bulletin, Vol. 27, No. 1A, June 1984, Uniform Pressure Roll, shows a roll with a solid roll core or frame. The roll does not have a tubular roll frame having a non-uniform rigidity.

OBJECTS AND SUMMARY OF THE INVENTION

Accordingly, it is an object of the present invention to provide a roll in which the drawbacks described above do not occur.

It is another object of the invention to provide a roll in whose lateral areas the loading is not higher than in the middle area.

It is another object of the invention to provide a new and improved paper machine roll, in particular a polymer-coated roll for use in a calender, multi-nip or supercalender.

It is yet another object of the invention to provide a new and improved method for calendering a web by passing the web through one or more nips defined by a hard roll and a polymer-coated roll.

In view of achieving the objects stated above and others, the roll in accordance with the invention is provided with a polymer coating having a variable deformativity or deformability, i.e., the ability to be deformed, which increases within a certain axial distance from the middle area of the roll towards the ends of the roll with a view toward compensating for the deformation state of the end areas of the roll frame, which deformation state is uneven when the roll is loaded.

According to an exemplifying embodiment of the invention, the roll frame has been relieved in the axial direction in the end areas so that the diameter of the roll frame becomes smaller over the specified axial distance toward the roll ends. The loading is equalized so that a coating that is thicker in the lateral areas is applied onto the roll frame whose ends have been relieved, i.e., the thickness of the coating is increased over the corresponding axial distance toward the roll ends so that, for example, the thickness of the entire coating is increased over this distance or, if a roll with a composite structure is concerned, the thickness of one layer in the coating is increased over this distance.

When such a roll is used in a situation in which there are rolls at both sides, for example in a supercalender, the loading can be equalized, because the lack of resilience is compensated for by means of the relief in the end areas of the roll, and the coating is accomplished so that it is thicker in the lateral areas than in the middle area of the roll.

According to a second embodiment of the invention, the inner structure of the roll coating in the end areas has been made such that the elasticity of the coating in the end areas compensates for the additional load produced by the uneven deformation of the roll frame (compare, e.g., FIG. 1).

In a basic embodiment of the method for calendering a web in accordance with the invention, a calendering nip is formed including a calender roll having an elongate, cylindrical frame extending in an axial direction of the roll and having a middle area and lateral areas having an axial length extending between an end of the middle area and a respective end of the frame. A polymer coating is arranged on the frame and has a first portion arranged on the middle area of the frame and a second portion arranged on each lateral area of the frame. The web is passed through the calendering nip defined at least in part by the calender roll whereby the frame of the calender roll undergoes a lesser deformation in the lateral areas than in the middle area. The lesser deformation of the lateral areas of the frame is compensated for by increasing the deformability of each second portion of the polymer coating in the lateral areas over the axial length from the end of the middle area to the respective end of the frame. In some embodiments, the diameter of the frame is decreased in the lateral areas over the axial length from the end of the middle area to the respective end of the frame, and optionally the thickness of the second portion of the polymer coating is increased in the lateral areas over the axial length from the end of the middle area to the respective end of the frame such that an outer diameter of the roll is substantially constant over the entire length of the roll in the axial direction. The polymer coating may consists of a plurality of layers, in which case, the thickness of one of the layers may be increased in the axial direction in the lateral areas over the axial length from the end of the middle area to the respective end of the frame such that an outer diameter of the roll is substantially constant over the entire length of the roll in the axial direction. Further, the second portions of the polymer coating may be provided with an inner structure with a different elasticity than the first portion of the polymer coating such that the second portions compensate for an additional load produced by the lesser deformation of the lateral areas of the frame.

In the following, the invention will be described in more detail with reference to the figures in the accompanying drawing. However, the invention is by no means strictly confined to the details of the illustrated embodiments.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1:
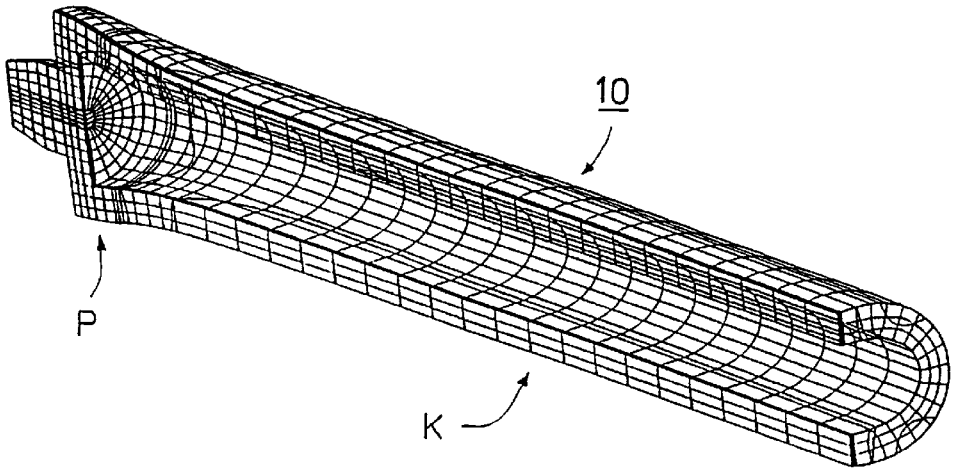
FIG. 1 is a schematic illustration of the state of deformation of the roll frame during loading.

Referring initially to FIG. 1, a roll with a polymer coating is denoted generally at 10 and it can be seen that the frame of rolls with a polymer coating is not of equal rigidity in the longitudinal direction of the roll 10, but rather the end areas P are more rigid than the middle area K of the roll 10. Thus, the load in the end areas P is higher than the load in the middle area K. This is evident from the variable deformation of the roll 10, i.e., the roll 10 is more deformed in the middle area than in the lateral areas in view of the greater rigidity in the lateral areas.

Figure 2:
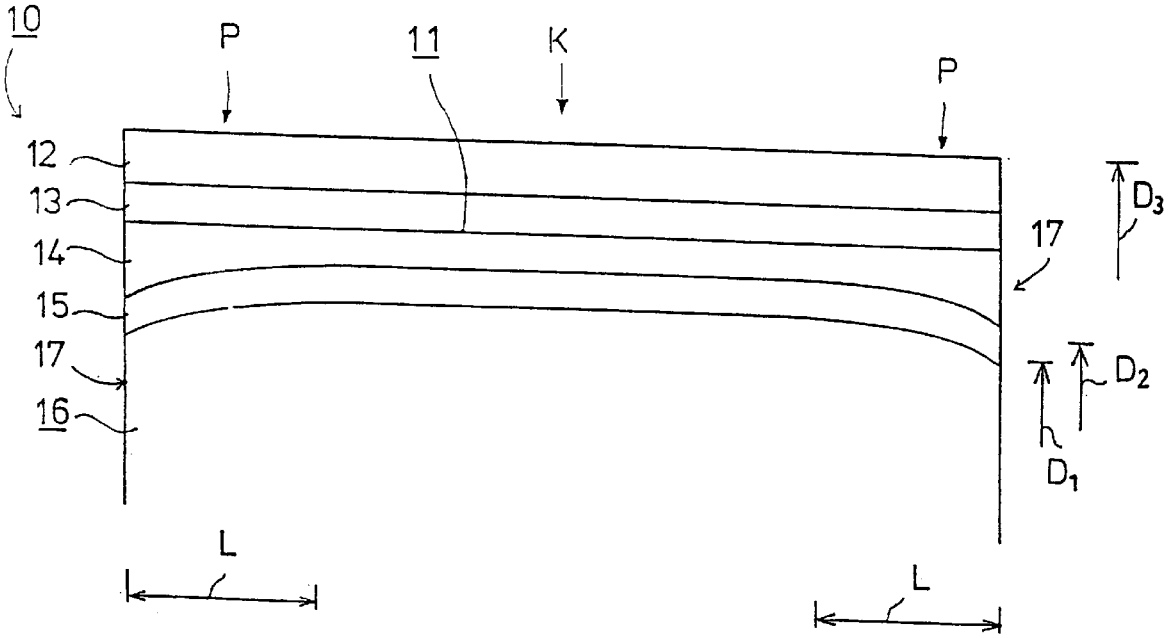
FIG. 2 is a schematic illustration in part of a roll in accordance with an exemplifying embodiment of the invention.

FIG. 2 is a schematic illustration in part of a roll in accordance with one exemplifying embodiment of the invention, in which, onto a tubular frame 16 of the roll 10 (as shown in FIG. 1), a polymer coating 11 having a multi-layer structure has been applied, for example an epoxy coating, which consists of a number of layers 12,13,14,15. The outer layer 12 is, for example, made of a polymer and it is followed in the axial direction by a binder layer 13 which is followed by a polymer layer 14, for example polyethylene, and then by a reinforcement layer 15, for example fiberglass. According to this exemplifying embodiment of the invention, the tubular roll frame 16 has been relieved in the end areas. More particularly, onto the tubular roll frame 16, from ends 17 of the roll 10 toward the middle, a relief has been formed over the distance or length L, which may depend on the diameter $D_2$ of the roll frame in the middle area, which distance L is about $0.4–1.5\times D_2$, preferably about $0.4–1.0\times D_2$, and optimally about $0.5–0.7\times D_2$. The diameter of the roll frame 16 becomes smaller toward the roll ends 17 over the axial distance L at each end 17. The diameter $D_1$ of the roll frame 16 is smaller at each end 17 of the roll compared with the diameter $D_2$ of the roll frame in the middle area. Also, $D_2$-$D_1$ is, e.g., from about 5 mm to about 30 mm, preferably from about 10 mm to about 20 mm. The end relief on the roll frame 16 is compensated for so that the polymer coating 11 is formed such that it becomes thicker in a corresponding way over the distance L, so that the outer diameter $D_3$ of the roll 10 remains substantially constant and invariable. In a multi-layer coating 11, one layer, for example the polymer layer 14 placed on the reinforcement layer 15, can be formed such that it becomes correspondingly thicker towards each end 17 of the roll, as is illustrated in the exemplifying embodiment shown in the figure. However, it is of course possible to vary the thickness of one of the other layers 12,13,15 to be thicker toward each end 17 of the roll 10 over the set axial distance or provide more than one layer with a increasing thickness toward each end 17 of the roll 10 over the set axial distance or length. In the illustrated embodiment, the thickness of polymer layer 14 is substantially constant over the middle area of the roll frame 16 and then gradually increases over the axial distance L toward the roll ends 17.

According to a second exemplifying embodiment of the invention, the inner structure of the roll 10 coating 11 in the end areas P is made such that the elasticity of the coating 11 in the end area P compensates for the additional load caused by the uneven deformation of the roll 10 frame 16 (cf. FIG. 1). In such a case, the end area P of the roll frame 16 can be relieved, or the additional load caused by the uneven deformation of the roll frame is substantially completely compensated for by arranging the inner structure of the coating 11 such that it compensates for this additional load.

Figure 3:
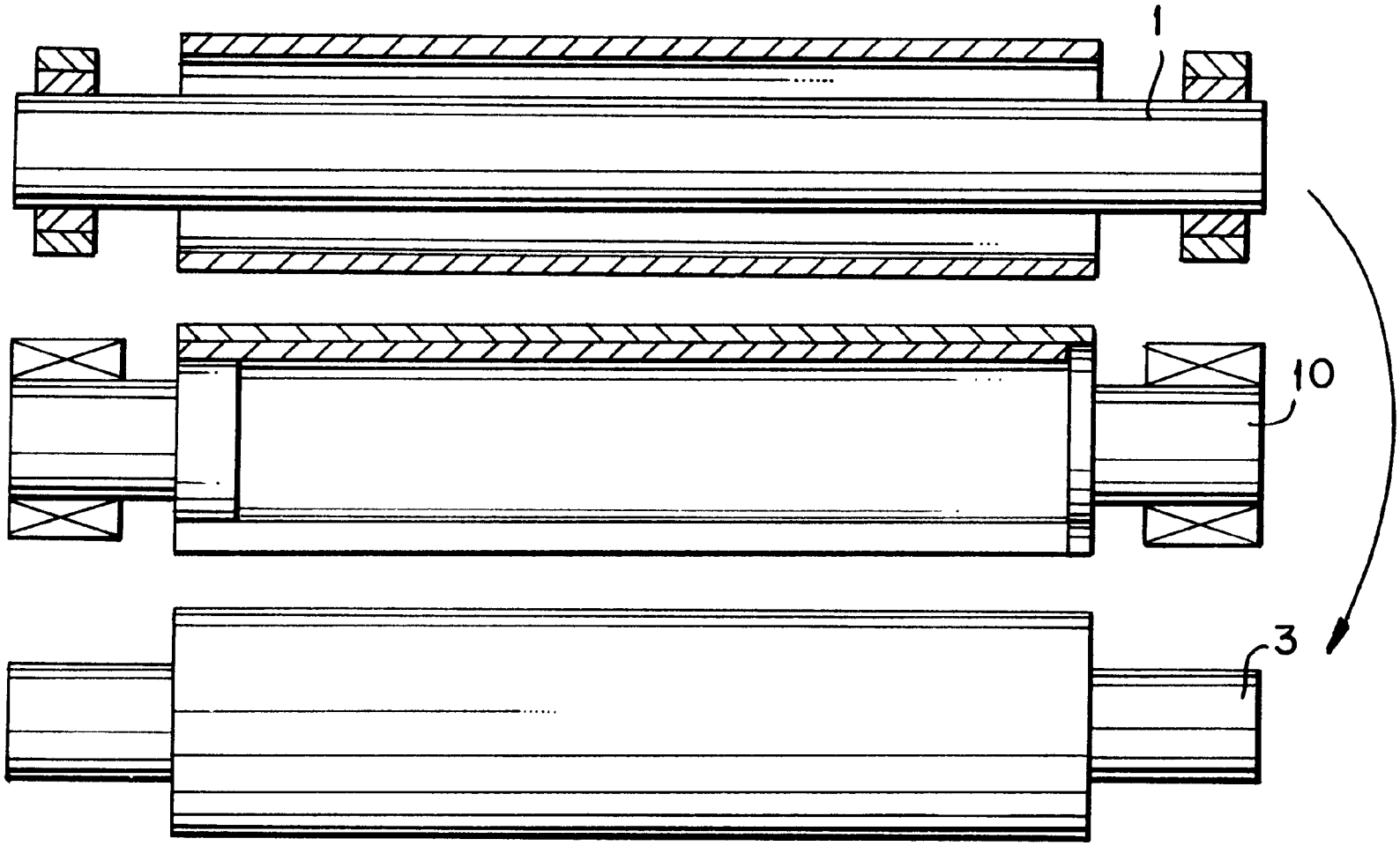
FIG. 3 is a view of a roll in accordance with the invention in a multi-nip calender.

As shown in FIG. 3, the roll 10 may be used in a multi-nip calender in a position between a pair of conventional calender rolls 1,3, each of which may be either a hard or soft-faced roll. As noted above, the structure of the frame of roll 10 is such that its resilience or deformability is not homogeneous so that it deforms more in the middle areas than in the lateral areas of the roll. This non-homogeneous deformation is compensated for by the coating 11 in the manner discussed above.

The examples provided above are not meant to be exclusive. Many other variations of the present invention would be obvious to those skilled in the art, and are contemplated to be within the scope of the appended claims.

We claim:

1. In a multi-nip calender including at least first, second and third calender rolls stacked in a substantially vertical column, said first calender roll being arranged between said second calender roll and said third calender roll such that said first calender roll defines a first calendering nip with said second calender roll and a second calendering nip with said third calender roll and is operatively loaded by said second and third calender rolls, the improvement comprising:

said first calender roll comprising an elongate, tubular frame having a hollow interior and extending in an axial direction of said first calender roll, said frame having a middle area and lateral areas having an axial length extending between an end of said middle area and a respective end of said frame, said frame having a non-uniform rigidity such that said frame deforms in a radial direction less in said lateral areas than in said middle area during loading of said first calender roll, a polymer coating arranged on said frame of said first calender roll for compensating for the lesser deformation of said lateral areas of said frame during loading of said first calender roll, said polymer coating having a first portion arranged on said middle area of said frame and a second portion arranged on each of said lateral areas of said frame, said polymer coating including a layer of polymer material, said layer of polymer material and said frame being arranged such that the thickness of said layer of polymer material increases in said lateral areas over the axial length from the end of said middle area to the respective end of said frame and such that an outer diameter of the roll is substantially constant over the entire length of the roll in the axial direction.

2. The calender of claim 1, wherein the diameter of said frame decreases in said lateral areas over the axial length from the end of said middle area to the respective end of said frame, and the thickness of said second portion of said polymer coating increases in said lateral areas over the axial length from the end of said middle area to the respective end of said frame.

3. The calender of claim 1, wherein said polymer coating consists of a plurality of layers.

4. The calender of claim 1, wherein the axial length of said lateral areas is from about 0.4 to about 1.5 times the diameter of said frame in said middle area.

5. The calender of claim 1, wherein said second portions of said polymer coating include an inner structure with a different elasticity than said first portion of said polymer coating such that said second portions compensate for an additional load produced by the lesser deformation of said lateral areas of said frame during loading of said first calender roll.

6. A method for calendering a web, comprising the steps of:

forming a first calendering nip between a first calender roll and a second calender roll, said first calender roll having an elongate, tubular frame having a hollow interior and extending in an axial direction of the roll, said frame having a non-uniform rigidity and a middle area and lateral areas having an axial length extending between an end of said middle area and a respective end of said frame, forming a second calendering nip between said first calender roll and a third calender roll such that said first, second and third calender rolls are stacked in a substantially vertical column, passing the web through said first and second calendering nips, loading said first calender roll in said first and second calendering nips such that said frame of said first calender roll deforms in a radial direction less in said lateral areas than in said middle area, arranging a polymer coating on said frame, said polymer coating having a first portion arranged on said middle area of said frame and a second portion arranged on each of said lateral areas of said frame, said polymer coating including a layer of polymer material, said layer of polymer material and said frame being arranged such that an outer diameter of the roll is substantially constant over the entire length of the roll in the axial direction, and compensating for the lesser deformation of said lateral areas of said frame by increasing the thickness of said layer of polymer material in said lateral areas over the axial length from the end of said middle area to the respective end of said frame.

7. The method of claim 6, further comprising the step of decreasing the diameter of said frame in said lateral areas over the axial length from the end of said middle area to the respective end of said frame.

8. The method of claim 7, wherein the thickness of said second portion of said polymer coating is increased in said lateral areas over the axial length from the end of said middle area to the respective end of said frame.

9. The method of claim 6, wherein said polymer coating consists of a plurality of layers.

10. The method of claim 6, further comprising the step of providing said second portions of said polymer coating with an inner structure with a different elasticity than said first portion of said polymer coating such that said second portions compensate for an additional load produced by the lesser deformation of said lateral areas of said frame.

11. The calender of claim 1, wherein said first calender roll is arranged such that the web is passed over an outer surface of said polymer coating of said first calender roll.

12. The method of claim 6, wherein the web is passed through said first and second calendering nips in contact with an outer surface of said polymer coating.

13. A calender roll for use in a multi-nip calender, consisting essentially of:

an elongate, tubular frame having a hollow interior and extending in an axial direction of the roll, said frame having a middle area and lateral areas having an axial length extending between an end of said middle area and a respective end of said frame, said frame having a non-uniform rigidity such that said frame deforms in a radial direction less in said lateral areas than in said middle area during loading of the roll, and a polymer coating arranged on said frame and having a first portion arranged on said middle area of said frame and a second portion arranged on each of said lateral areas of said frame, said polymer coating including a layer of polymer material, said layer of polymer material and said frame being arranged such that the thickness of said layer of polymer material increases in said lateral areas over the axial length from the end of said middle area to the respective end of said frame and such that an outer diameter of the roll is substantially constant over the entire length of the roll in the axial direction.

14. The roll of claim 13, wherein the diameter of said frame decreases in said lateral areas over the axial length from the end of said middle area to the respective end of said frame, and the thickness of said second portion of said polymer coating increases in said lateral areas over the axial length from the end of said middle area to the respective end of said frame.

15. The roll of claim 13, wherein said polymer coating consists of a plurality of layers.

16. The roll of claim 13, wherein the axial length of said lateral areas is from about 0.4 to about 1.5 times the diameter of said frame in said middle area.

17. The roll of claim 13, wherein said second portions of said polymer coating include an inner structure with a different elasticity than said first portion of said polymer coating such that said second portions compensate for an additional load produced by the lesser deformation of said lateral areas of said frame during loading of the roll.

18. The roll of claim 13, wherein an outer surface of said polymer coating constitutes a web-contacting surface.

* * * * *